US009255363B2

(12) United States Patent
Landstrom et al.

(10) Patent No.: US 9,255,363 B2
(45) Date of Patent: Feb. 9, 2016

(54) MANUALLY OPERATED ARRANGEMENT

(75) Inventors: Jacob Landstrom, Norrala (SE); Martin Somerset, Workshop (GB); Bjorn Soderberg, Soderhamn (SE)

(73) Assignee: ROSENQVIST RAIL AB, Hudiksvall (SE)

( * ) Notice: Subject to any disclaimer, the term of this patent is extended or adjusted under 35 U.S.C. 154(b) by 105 days.

(21) Appl. No.: 13/988,335

(22) PCT Filed: Nov. 15, 2011

(86) PCT No.: PCT/SE2011/051374

§ 371 (c)(1),
(2), (4) Date: May 19, 2013

(87) PCT Pub. No.: WO2012/067576

PCT Pub. Date: May 24, 2012

(65) Prior Publication Data

US 2013/0239840 A1 Sep. 19, 2013

(30) Foreign Application Priority Data

Nov. 19, 2010 (SE) ..... 1001121

(51) Int. Cl.
*E01B 29/14* (2006.01)
*E01B 29/24* (2006.01)

(52) U.S. Cl.
CPC ..... *E01B 29/14* (2013.01); *E01B 29/24* (2013.01)

(58) Field of Classification Search
CPC ..... E01B 29/14; E01B 29/24
USPC ..... 104/7.1, 17.2
See application file for complete search history.

(56) References Cited

U.S. PATENT DOCUMENTS 4,068,593 A 1/1978 Leeves
4,494,463 A * 1/1985 Young et al. ..... 104/17.2

(Continued)

FOREIGN PATENT DOCUMENTS

GB 952055 * 6/1959 ..... B41F 1/08
WO 95/13427 A1 5/1995
WO 98/59113 A1 12/1998
WO 2006/031168 A1 3/2006

OTHER PUBLICATIONS

Notification Concerning Transmittal of International Preliminary Report on Patentability (Chapter I of the Patent Cooperation Treaty) issued by the International Bureau of WIPO in International Application No. PCT/SE2011/051374 on May 30, 2013.

(Continued)

*Primary Examiner* — Zachary Kuhfuss
(74) *Attorney, Agent, or Firm* — Raymond R. Ferrera; Adams and Reese LLP

(57) ABSTRACT

The present invention embraces a manually operated arrangement ("A") and a method, adaptable for a transfer along a longitudinal extension of a rail (1) and intended to be able to secure said rail to a subjacent crosstie (2) by a horizontal transfer of clips (3: 3*a*), included in fastening elements (4), and displaceably oriented in relation to a holder (5) included in the fastening element (4), where the holder (5, 5*a*) co-operates firmly with said crosstie (2). The respective one of said clips (3; 3*a*) is adapted to, by a movement, allow displacing the clips (3: 3*a*) horizontally for a clamping of the rail base (1*c*) in relation to the holder (5). An opposed first pair (6*a*, 6*b*) of a first lever-shaped means (6) is adapted to, via its lower end areas (6*aa*, 6*ab*) co-operate with the clips. For this purpose, the invention provides a means (20, 21, 23) lifting the crosstie (2) with holders (5) and clips (3) up to the rail base, which means is adapted adjustable in height ("D").

15 Claims, 4 Drawing Sheets

(56) References Cited

U.S. PATENT DOCUMENTS

| | | | | |
|---|---|---|---|---|
| 5,586,502 | A * | 12/1996 | Weber | 104/17.2 |
| 7,258,069 | B1 * | 8/2007 | Cotsford | 104/7.1 |
| 7,574,961 | B2 * | 8/2009 | Barezzani et al. | 104/17.2 |
| 8,499,695 | B1 * | 8/2013 | Petkov | 104/17.2 |
| 2006/0130697 | A1 * | 6/2006 | Hertelendi et al. | 104/2 |

OTHER PUBLICATIONS

International Search Report issued by the SE International Searching Authority in International Application No. PCT/SE2011/051374 on Feb. 16, 2012.

* cited by examiner

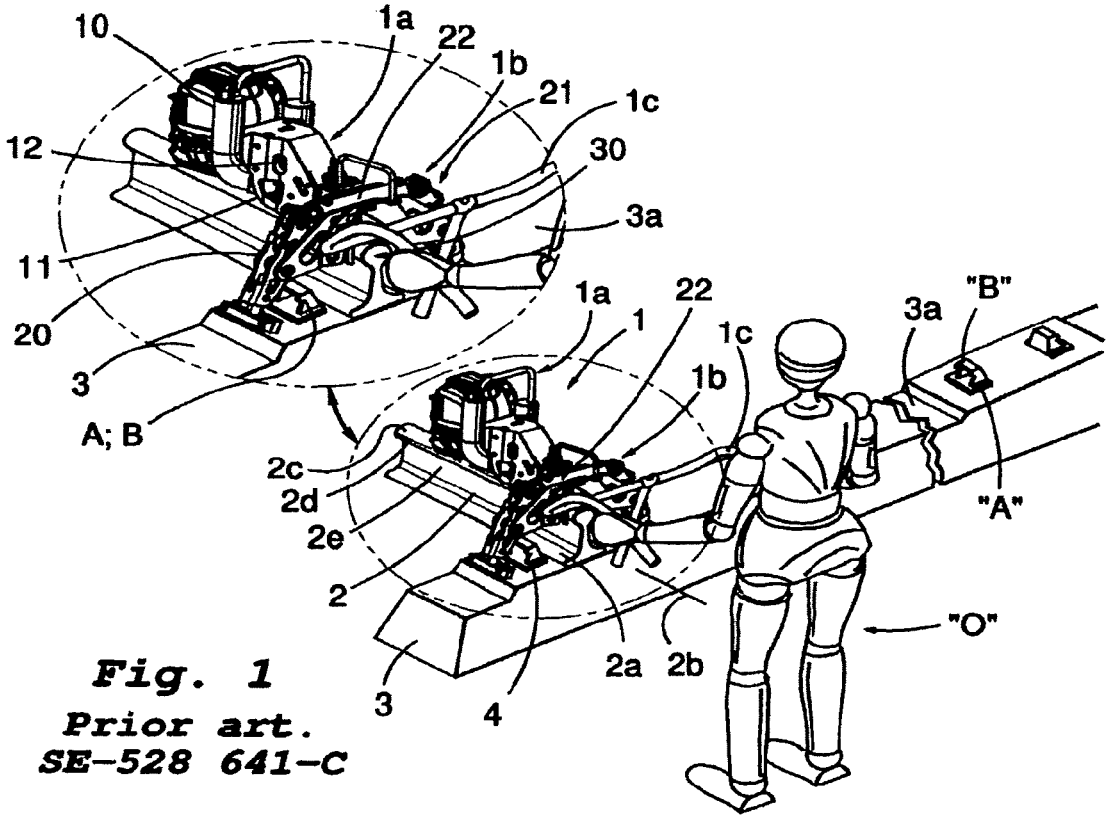
*Fig. 1*
*Prior art.*
*SE-528 641-C*
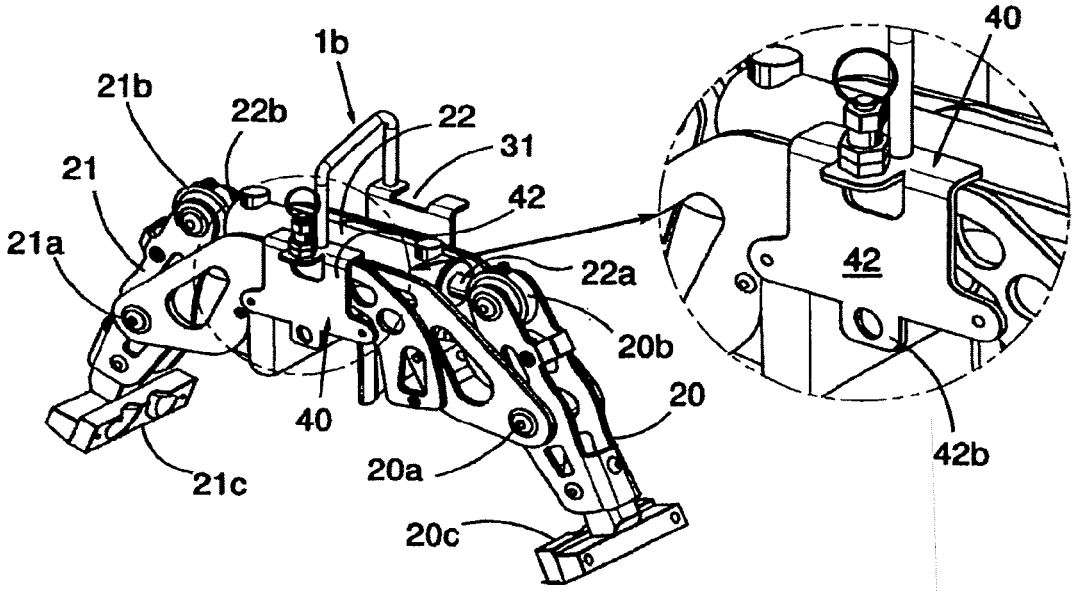

MANUALLY OPERATED ARRANGEMENT

TECHNICAL FIELD OF THE INVENTION

The present invention generally relates to a manually operated arrangement as well as to a method for, in a selected sequence, allowing actuating the arrangement for a securing movement of clips, preferably opposed clips, included in fastening elements co-ordinated with a crosstie on each side of a rail base of a rail.

More particularly, the present invention concerns obtaining an application in an arrangement having the features defined in the preamble of appended claim 1, alternatively obtaining an application in a method having the features defined in the preamble of appended claim 12.

In a securement of a rail against a subjacent crosstie, there are utilized fastening elements on each side of the rail, and where these fastening elements are firmly anchored to a subjacent crosstie. Each one of the fastening elements consists of at least one holder, attached to the crosstie, and one clip, which is displaceably oriented in relation to the holder between a position detaching the rail base and a position co-operating with the rail base. In a securement, the clips should assume a position that, via a spring force, co-operates with the upper surface areas of the rail base.

In an unsecurement of a rail from a subjacent crosstie, the clips should be displaced from their securing positions, in the position where they, by a spring force, co-operate with the upper surface areas of the rail base, into positions uncovering the rail base.

BACKGROUND OF THE INVENTION

Methods, arrangements and designs related to the above-mentioned technical field and nature are previously known in a plurality of different embodiments.

As a first example of the background art and technical field to which the invention relates, what is shown and disclosed in the patent publication SE-528 641-C may be mentioned.

Here, in FIG. 1, an arrangement (1) easily manoeuvrable by an operator (O) is shown and described, which is adapted for a displacement along a railway track (2) and has a tool assembly (1*b*) that is provided with a pliers function and is in the form of a piston-cylinder arrangement (22), adapted to, via the movement of a piston part within a cylinder part, allow displacing pliers' branches (20, 21) to and from railway track sections and securing parts (A; B) related thereto.

More particularly, here, it is shown that said tool assembly (1*b*) is allocated a first coupling device (31), included in a first two-piece coupling means (30), adapted for a co-operation with a second coupling device (32), related to an operating rod or handle (1*c*), and that said tool assembly (1*b*) is allocated a second coupling device (42), included in a second two-piece coupling means (40), adapted for a co-operation with a first coupling device (41) related to a power unit (1*a*).

The embodiment shown here provides means for a securement of paired clips to the upper surface portions of a rail base.

Considering the present invention and its function to secure a rail base to a holder and its crosstie, it could be mentioned that it is previously known to provide an arrangement, adapted to the crosstie with holders and clips, and a means that is co-ordinated to the arrangement and lifts the crosstie up to the rail base, and where said means may comprise an extensible and a shortenable device, such as a hydraulic piston-cylinder assembly.

Accordingly, an arrangement is known marketed by ROBEL for lifting the sleeper up to the lower surface of the rail base, and then securing the clips to the upper surface portions of the rail base.

For this purpose, there is utilized a vertically oriented piston-cylinder assembly fixedly united to the chassis, which with its piston part only will be able to move up and down vertically and thereby be able to press vertically against the wear surface of the rail head.

This firm co-operation of the piston-cylinder assembly to the chassis has turned out to give adverse drawbacks. Here, the piston-cylinder assembly is fixed next to and beside the arrangement that, by turnable levers, should execute the proper securing function.

SUMMARY OF THE PRESENT INVENTION

Technical Problem

If attention is paid to the circumstance that the technical considerations that a person skilled in the relevant technical field has to make to be able to present a solution to one or more technical problems raised, are, on one hand, initially a necessary understanding of the measures and/or the sequence of measures that have to be taken, and on the other hand a necessary selection of the means that is/are required, then the subsequent technical problems would, in view of this, be relevant in the creation of the present subject matter of invention.

Considering prior art, such as it has been described above, it should, therefore, be seen as a technical problem to be capable of realizing the significance of, the advantages associated with and/or the technical measures and considerations that will be required to improve and guarantee a design having allocated functions related to the above-mentioned and known arrangement in the Swedish patent publication.

There is a technical problem to be capable of realizing the significance of, the advantages associated with and/or the technical measures and considerations that will be required to allow supplementing an arrangement, according to the preamble of claim 1, so that the same can execute a method that is based on, by one and the same extensible and shortenable device, such as a piston-cylinder assembly, in a sequence, allowing a means lifting the crosstie to the rail base to be adjustable, such as in initial height, so as to, in a tilted adjustment, correspond to, or at least essentially correspond to, an adapted height between the rail base and the holder of a subjacent crosstie including clips belonging thereto.

There is a technical problem to be capable of realizing the significance of, the advantages associated with and/or the technical measures and considerations that will be required to allow said means to comprise an extensible and/or shortenable device, such as a hydraulic piston-cylinder assembly.

There is a technical problem to be capable of realizing the significance of, the advantages associated with and/or the technical measures and considerations that will be required to, for a selected height of said device, allow said device to be adapted to assume a fully extended, or at least essentially fully extended, position.

There is a technical problem to be capable of realizing the significance of, the advantages associated with and/or the technical measures and considerations that will be required to allow said lifting means, including the device belonging thereto, to be turnably fixed, via a horizontal turning shaft, to its upper part.

There is a technical problem to be capable of realizing the significance of, the advantages associated with and/or the technical measures and considerations that will be required to allow said device to be vertically adjustable via a manually actuatable handwheel that is co-operatable with a threaded rod.

There is a technical problem to be capable of realizing the significance of, the advantages associated with and/or the technical measures and considerations that will be required to allow said device to be adapted to assume an acute angle to a centre line assigned to the rail.

There is a technical problem to be capable of realizing the significance of, the advantages associated with and/or the technical measures and considerations that will be required to allow said device to be adapted to, at its lower part, co-operate with a roll, adapted for a co-operation with an upper surface portion or wear surface allocated to the rail head.

There is a technical problem to be capable of realizing the significance of, the advantages associated with and/or the technical measures and considerations that will be required to allow the first pair of levers in the first lever-shaped means to be adapted for a lowering down to and a supporting co-operation with clips, laterally related to the rail base, and the crosstie, and, via said means and said device, allow lifting the clips, and, in a thus raised position, allow creating a counter-directed movement of the clips across the upper surfaces of the rail base.

There is a technical problem to be capable of realizing the significance of, the advantages associated with and/or the technical measures and considerations that will be required to allow said roll to be allocated a centrally oriented rolling surface, having a peripheral cylinder shape connecting to an upper support or wear surface assigned to the rail head.

There is a technical problem to be capable of realizing the significance of, the advantages associated with and/or the technical measures and considerations that will be required to allow the rolling surface to be adapted to extend between two end portions, having diameters that are related to the end portions and exceed a selected diameter of the rolling surface.

There is a technical problem to be capable of realizing the significance of, the advantages associated with and/or the technical measures and considerations that will be required to allow the lower support surfaces of the first lever-shaped means to be adapted for a parallel displacement in the horizontal direction toward each other, via a system of parallel levers, and an extension of the device.

There is a technical problem to be capable of realizing the significance of, the advantages associated with and/or the technical measures and considerations that will be required to allow a method, in a manually operated arrangement, adaptable for a transfer along a longitudinal extension of a rail and intended to be able to secure said rail against and to a subjacent crosstie by a transfer of paired clips, included in fastening elements, according to the preamble of claim 13, teach that said means lifting the crosstie to the rail base should, as concerns its height position, be adjustable so as to, in a selected adjustment position, correspond to, or at least essentially correspond to, a selected, such as maximized, height between the rail base and a holder that is assigned to a detached crosstie and has clips carried thereon.

There is a technical problem to be capable of realizing the significance of, the advantages associated with and/or the technical measures and considerations that will be required for allowing the first lever-shaped means, at its lower end portions, to be provided with squeezing means co-ordinated to the clips, for initial forces on said squeezing means to be adapted to be less than an occurring static friction between the clips and their holders, however, a shape corresponding to the shape of the free end of the clip should be adapted to be able to lift the clips, the holder and the crosstie to the underside of the rail base as well as thereupon allow increasing the forces in order to displace the clips toward each other for a securing movement.

There is a technical problem to be capable of realizing the significance of, the advantages associated with and/or the technical measures and considerations that will be required to allow an extensible and/or shortenable device belonging to the means, in said initial adjustment position, to assume a fully extended, or at least essentially fully extended, position.

There is a technical problem to be capable of realizing the significance of, the advantages associated with and/or the technical measures and considerations that will be required to allow said pair of levers in the first lever-shaped means to be adapted to initially assume a position registering with the clips, and, by forces less than counter-directed forces and requisite for an overcoming of an occurring static friction between clips and holders but sufficiently great for lifting the crosstie, to allow lifting the crosstie with holders for a registration against the lower surface of the rail base, to allow positioning the rail base against the crosstie and its holders, and to activate the horizontal displacement of the clips, for a securing co-operation with the upper surface portions of the rail base.

The Solution

In that connection, the present invention starts out from the known technique provided by way of introduction and is based on an arrangement according to the preamble of claim 1.

In order to be able to solve one or more of the above-mentioned technical problems, the present invention particularly teaches that the thus known technique should be supplemented with the features defined in the characterizing clause of claim 1.

As proposed embodiments, falling within the scope of the fundamental idea of the present invention, moreover the features defined in the dependent claims are provided.

The invention also embraces a method that utilizes an arrangement according to the invention and that has been assigned the sequence of features that are defined in the characterizing clause of claim 12.

Advantages

The advantages that foremost may be regarded as characteristic of the present invention and the special significative features provided thereby are that, in this way, conditions have been created in order to, in an arrangement according to the invention and a method related thereto, allow providing a more secure arrangement and having improved functionalities than what the known technique has turned out to be able to produce.

More particularly, it is taught that a means lifting the crosstie to the rail base should be adjustable in height, so as to, in an adjustment correspond to, or at least essentially correspond to, an adapted and selected height between the rail base and the holder of a subjacent crosstie including clips belonging thereto.

The lifting means should furthermore be turnably fixed at its upper part to the chassis but still fixedly related to a tilted adjustment.

In addition, a pair of levers in a first lever-shaped means should be adapted to initially be able to assume a position registering with the clips, and by counter-directed forces less than the forces that are requisite for an overcoming of an occurring static friction between clips and holders, to be able to lift the crosstie with holders via the clips to the lower surface of the rail base, to be able to position the rail base against the crosstie and its holders or vice versa, and to be able to activate the horizontal displacement of the clips, for a securing co-operation with the upper surface portions of the rail base.

BRIEF DESCRIPTION OF THE DRAWINGS

Prior art and a presently proposed embodiment, having the significative features associated with the invention, will now, for the purpose of exemplifying, be described in more detail with reference to the appended drawing, wherein:

FIG. 1 shows, as prior art, the Swedish patent publication SE-528 641-C mentioned by way of introduction.

DESCRIPTION OF PRIOR ART ACCORDING TO FIG. 1

The known technique is described in more detail in the Swedish patent publication mentioned by way of introduction, and for a more brief account, reference is made to the section "Background of the Invention" above.

DESCRIPTION OF A PRESENTLY PROPOSED EMBODIMENT

It should then by way of introduction be emphasized that in the subsequent description of a presently proposed embodiment, which has the significative features associated with the invention and which is elucidated by the figures shown in the appended drawings, we have selected terms and a particular terminology with the intention to thereby primarily allow making evident the proper inventive idea.

It should, however, in this connection be taken into consideration that expressions selected here should not be seen as limiting solely to the terms utilized and selected here, but it should be understood that each term selected in this manner should be interpreted so that it, in addition, will be able to comprise all technical equivalents operating in the same or substantially the same way in order to, in this way, enable the achievement of the same or substantially the same intention and/or technical effect.

Thus, with a reference to the appended FIGS. 2 to 11, the fundamental conditions of the present invention are shown schematically and in detail, and where the significative features associated with the invention have been made concrete, by the presently proposed embodiment described more in detail in the following.

Figure 2:
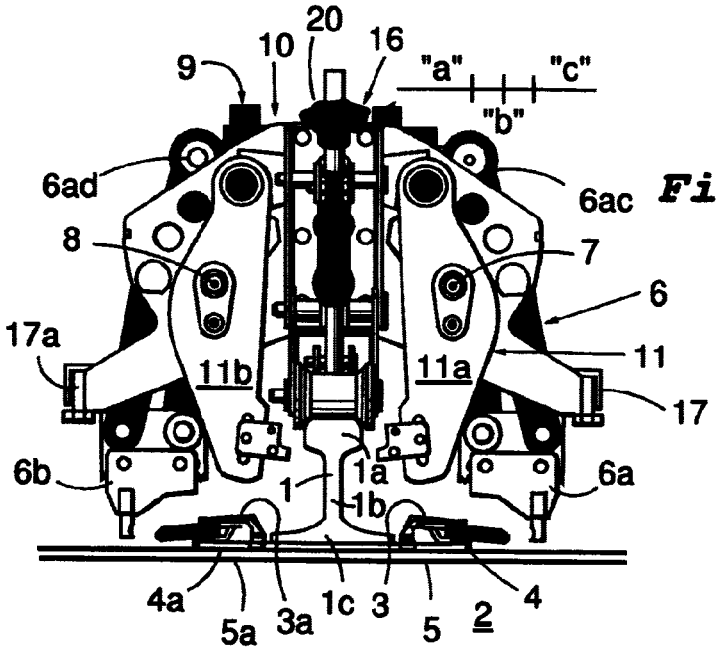
FIG. 2 shows in a side view the arrangement according to the invention having an extensible and shortenable device, here assuming a fully shortened position "a" and where extended positions "b" and "c" only are outlined.

Accordingly, FIG. 2 shows a manually operated arrangement "A", adaptable for a transfer along a longitudinal extension of a rail 1, having a cross-section formed by an upper rail head 1*a*, a rail web 1*b* and a lower rail base 1*c* and intended to be able to secure said rail 1 to a subjacent crosstie 2 by a horizontal transfer of the respective clip 3: 3*a*, included in each a fastening element 4, 4*a*, and displaceably oriented along a holder 5, 5*a* included in the fastening element 4, 4*a* and attached to the crosstie in a known way.

Each one of said holders 5, 5*a* co-operates firmly in a known way with said crosstie 2 on each side of the rail base 1*c*, and where the respective one of said clips 3; 3*a* is adapted to, by a movement, allow displacing the clips 3: 3*a* toward each other horizontally for a clamping of the rail base 1*c* in relation to the holders 5, 5*a*.

An opposed first pair 6*a*, 6*b* of a first lever-shaped means 6 is adapted to, via its lower end areas, 6*aa*, 6*ab* (FIG. 3), co-operate with each a clip 3, 3*a* in order to activate their counter-directed, horizontal movements, said first lever-shaped means 6, with its first pair of levers 6*a*, 6*b*, being turnably arranged around the respective middle horizontal turning shafts 7, 8.

Via their upper end areas 6*ac*, 6*ad*, they co-operate with an extensible or shortenable device 9, here illustrated as a hydraulic piston-cylinder assembly 10. Said end areas 6*ac*, 6*ad* should be brought from each other between the indicated positions "a", "b" and "c" in a securing movement of the clips 3, 3*a*, Here, said device 9 is arranged to directly or indirectly co-operate with a first pair 11*a*, 11*b* of a second lever-shaped means 11, which is adapted to, via its lower end areas 11*aa*, 11*ab*, be so movably arranged that said end areas 11*aa*, 11*ab*, by counter-directed tensional forces, become adapted to co-operate firmly with averted support surfaces assigned to the rail head 1*a*.

Said levers serve their function in an unsecurement of the rail from a subjacent crosstie 2.

The second lever-shaped means 11 presents a respective lever's 11*a*, 11*b* support surface 12, 12*a*, where each one of said support surfaces 12, 12*a* are formed, adapted and intended to abut against their surface portions laterally related to the rail head 1*a* and/or their surface portions subjacent the rail head 1*a*. The support surfaces 12, 12*a* are formed in order not to only abut against the averted vertical portions of the rail head, but in addition abut against the more horizontal surface portions of the rail head. Said surface portions are raisable and lowerable by means of a sawtooth co-operation and an attaching means not shown.

Figure 3:
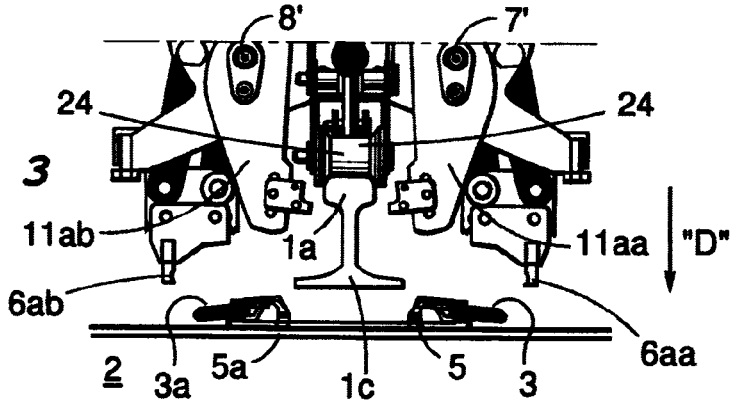
FIG. 3 shows the lower lever parts of a first lever-shaped means adjacent to the rail, when the maximized or selected distance "D" should be regulated for a said means lifting the crosstie, holders and clips up to the rail base.

The second lever-shaped means 11 with its pair 11*a*, 11*b*, co-operates turnably with each a turning shaft 7', 8' (according to FIG. 3).

Figure 4:
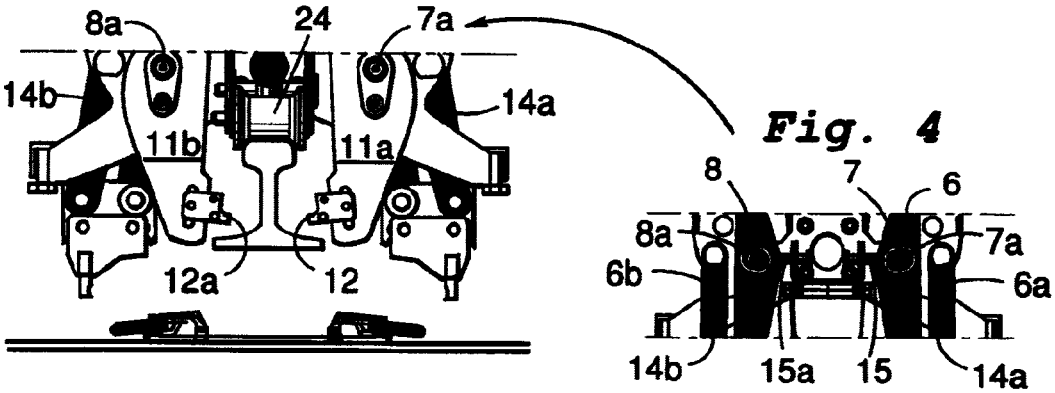
FIG. 4 shows the positions of the first lever-shaped means in an initial lifting movement.
Figure 5:
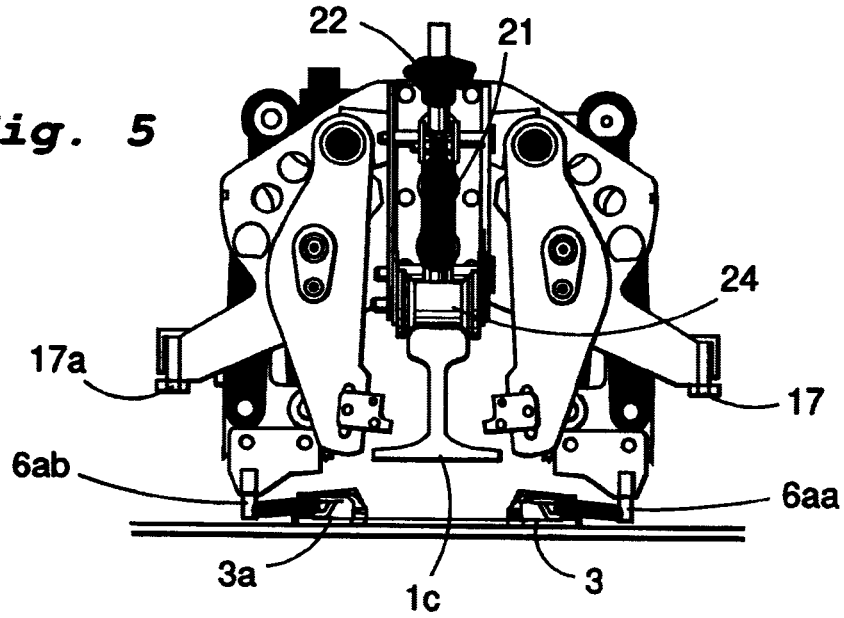
FIG. 5 shows the co-ordination of the first lever-shaped means with the two clips in a raised position.
Figure 6:
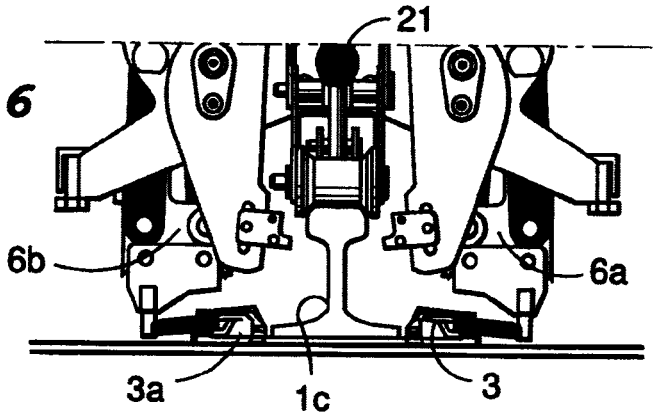
FIG. 6 shows a raised position of a close co-operation between the crosstie and the holders in order to, in this position, be able to displace the clips into a co-operation with the upper surface areas of the rail base.
Figure 7:
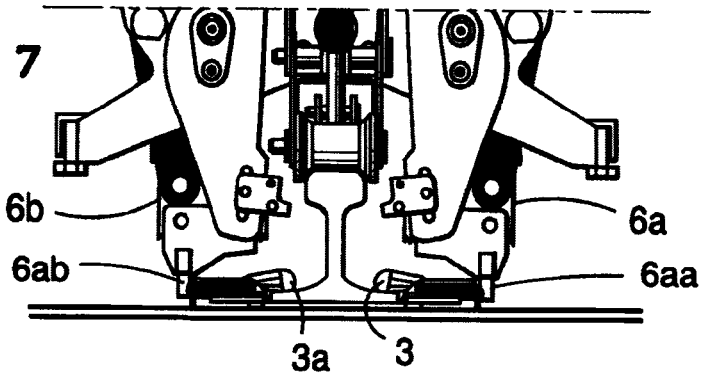
FIG. 7 shows a position where the extending movement of the device displaces opposed clips up to a co-operation with the upper surface portions of the rail base.

According to FIG. 4, the respective lever 11*a*, 11*b* in the means 11 should be co-ordinated, via the shafts 7, 8, with a bushing 7*a*, 8*a*, having a horizontally, or at least essentially horizontally, oriented guidance for a displacement of the centre and lower areas of the levers in relation to the turning shaft in a horizontal or at least essentially horizontal direction.

The lower end areas 6*aa*, 6*ab* of the first lever-shaped means 6 are adapted for a parallel displacement in the horizontal direction, via a system of parallel levers, comprising the levers 6*a*; 14*a* and 6*b*; 14*b*, respectively.

From FIG. 4, it is seen that each one of the shafts 7, 8, via support from the bushings 7*a*, 8*a*, is pressed outward by each a spring pile 15, 15*a*, and that the shafts 7, 8 will be pressed within their bushing 7*a*, 8*a* by the outgoing movement of the device 9.

By means of a cog co-operation 16, the movements of the levers 11*a*, 11*b* are co-ordinated for a uniform turning movement. Stop members 17, 17*a* are arranged to limit the motion of turning of the first lever-shaped means 6 around the turning shafts.

Figure 8:
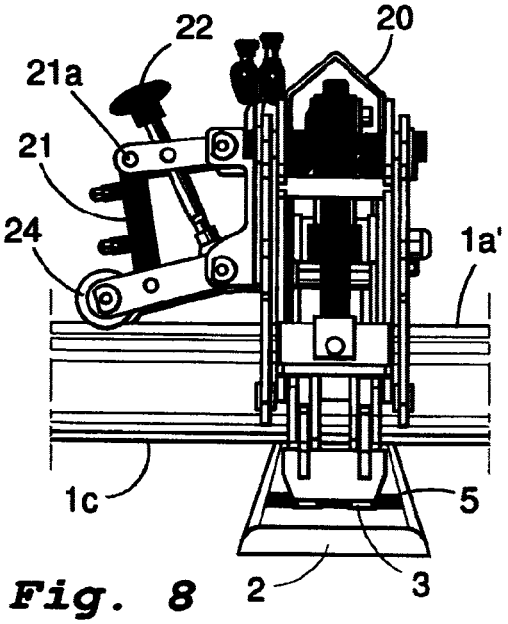
FIG. 8 shows the lifting means in a view where said means assumes a position intended for an initial lifting (compare FIG. 3)
Figure 9:
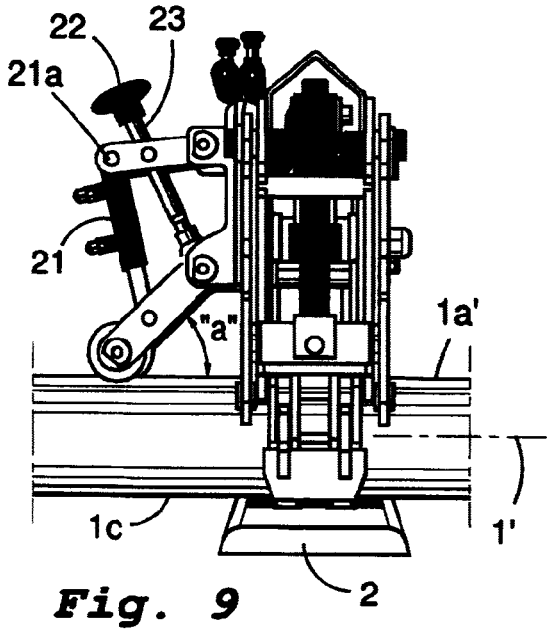
FIG. 9 shows the lifting means in a view where said means assumes a fully raised position (FIGS. 6 and 7)
Figure 10:
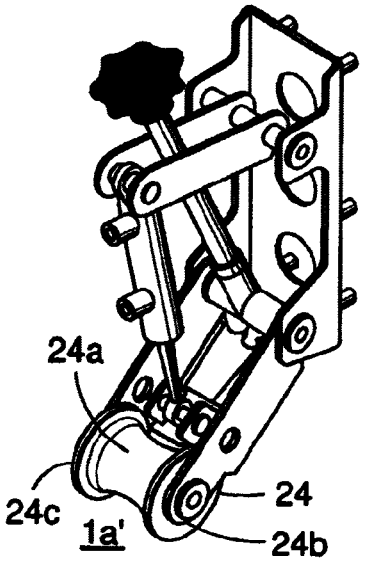
FIG. 10 shows in a perspective representation the lifting means with its extensible and shortenable device, in the form of a piston-cylinder assembly.
Figure 11:
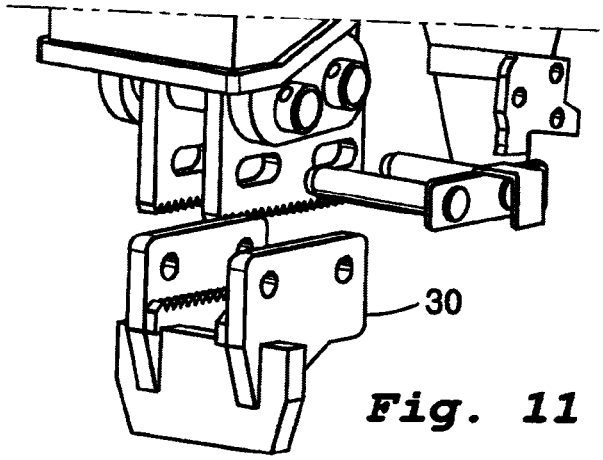
FIG. 11 shows a proposed embodiment of a separate support surface of the lowermost end of the first lever-shaped means, in order to firmly but easily releasably be able to attach a unit adapted for a securement of the clips to the rail base, and which unit easily should be replaceable by another unit for an unsecuring function.

Starting out from the arrangement described above, the present invention is based on the utilization of a means 20 lifting the crosstie with holders and clips up to the rail base (FIGS. 8 and 9).

Said means 20 lifting the crosstie to the rail base should be adjustable in initial height (see FIG. 9) so as to, in an initial adjustment, correspond to, or at least essentially correspond to, a maximized height "D" between the rail base 1*c* and the holder 5 of a subjacent crosstie including clips 3 belonging thereto.

Said means 20 should then comprise an extensible and/or shortenable device 21, such as a hydraulic piston-cylinder assembly.

At a maximized height "D" of said device, said device 21 is adapted to assume a fully brought together, or at least essentially fully brought together, position.

Said lifting means 20, with the device 21 belonging thereto, should be turnably fixed, via a turning shaft, to its upper part 21*a*.

Here, said device 21 is suggested to be vertically adjustable via a manually actuatable handwheel 22 co-operatable with a threaded rod 23.

Said device is adapted to assume an acute angle "a" to a centre line 1' assigned to the rail 1.

Said device 21 is adapted to, at its lower part, co-operate with a roll 24, adapted for a co-operation with an upper surface portion or wear surface 1*a*' allocated to the rail head 1*a*.

The first pair of levers 6*a*, 6*b* in the first lever-shaped means 6 is adapted for a lowering down to and a supporting co-operation with clips 3, 3*a*, laterally related to the rail base 1*c*, and the crosstie, and, via said means and said device, allow lifting the clips 3, 3*a*, and, in a thus raised position, allow creating a counter-directed movement of the clips 3, 3*a* across the upper surfaces of the rail base 1*c*.

Said roll 24 is allocated a centrally oriented rolling surface 24*a* having a peripheral cylinder shape connecting to an upper support or wear surface 1*a*' assigned to the rail head.

The rolling surface 24*a* is delimited by end portions 24*b*, 24*c*, having diameters that are related to the end portions and exceed a selected diameter of the rolling surface.

The lower support surfaces of the first lever-shaped means 6 are adapted for a parallel displacement in the horizontal direction toward each other, via a system of parallel levers, and an extension of the device 9.

As for the setting of the machine, significative for the invention, so that it should obtain an adapted and correct height, there is provided, considering FIGS. 2 and 4.

When the machine or the arrangement is above a crosstie 2 that is in close contact with the underside of the rail base 1*c* and the lifting cylinder 21 is in its fully extended position, then, by means of the handwheel 22, the securing steels (at the end portions 6*aa*, 6*ab*) should be in the correct vertical position in relation to the clips 3, 3*a*.

When the arrangement is moved to a position immediately above a crosstie 2, which, e.g., has a distance "D" corresponding to 35 mm, then the lifting cylinder or the device 21 is shortened until the steels at the end portions 6*aa*, 6*ab* rest against the top side of the crosstie so as to, in this way, assume a registered position.

Should the arrangement be moved to a crosstie 2 that has the distance "D" corresponding to 70 mm, then the device 21 will be shortened maximally and the steels at the end portions 6*aa*, 6*ab* will not reach sufficiently far down for a co-operation with the clips 3, 3*a*.

FIG. 4 then illustrates a distance "D" that connects to the maximal one the arrangement can manage. If the distance "D" would increase, then the arrangement cannot reach down to the clips 3, 3*a*, and if the distance "D" would decrease, then the arrangement, with its steels, means or end portions 6*aa*, 6*ab* will rest against or connect closely to the crosstie 2 (according to FIG. 4), which from experience often will be the case.

The invention also embraces a method for, in a manually operated arrangement "A", adaptable for a transfer along a longitudinal extension of a rail 1 and intended to be able to secure said rail against and to a subjacent crosstie 2 by a transfer of paired clips 3, 3*a*, included in fastening elements 4, and displaceably oriented along a holder 5 included in the fastening element 4, where the holder co-operates firmly with said crosstie 2, and where the respective one of said clips 3, 3*a* is adapted to, by a movement, allow displacing the clips 3, 3*a* for a clamping to said rail base 1*c* along the respective holder 5, in accordance with the preamble of claim 12.

The first pair of levers 6*a*, 6*b* of the first lever-shaped means 6 are, at their lower end portions, provided with squeezing means 30 co-ordinated to the clips 3, 3*a*.

In this connection, the forces on said squeezing means should be adapted to be less than an occurring static friction between the clips 3, 3*a* and their holders 5, 5*a*.

A shape corresponding to the shape of the free end of the clip is adapted to be able to lift the clips 3, 3*a*, the holder 4, 4*a* and the crosstie 2 to the underside of the rail base 1*c* as well as thereupon increase the forces in order to displace the clips toward each other for a securing movement.

The extensible and/or shortenable device 21 belonging to the means should, in said initial adjustment position, assume a fully extended, or at least essentially fully extended, position.

Said pair of levers 6*a*, 6*b* in the first lever-shaped means 6 is adapted to initially assume a position registering with the clips (FIG. 4), and, by forces less than counter-directed forces and requisite for an overcoming of an occurring static friction between clips and holders, to allow lifting the crosstie with holders to the lower surface of the rail base (FIG. 6), to allow positioning the rail base 1*c* against the crosstie 2 and its holders 5, and to allow activating the horizontal displacement of the clips (FIG. 7), for a securing co-operation with the upper surface portions of the rail base.

The invention is of course not limited to the embodiment given above as example, but may be subjected to modifications within the scope of the general idea according to the invention, illustrated in the subsequent claims.

Particularly, it should be taken into consideration that each unit and/or category shown can be combined with any other unit and/or category shown within the scope in order to be able to attain the desired technical function.

Concurrently with this application, an application, embracing a "Manually operated arrangement", has been filed that is aimed at an unsecurement of a rail base from a crosstie with holders and clips related laterally, and with the same applicant and inventor as in this application.

The invention claimed is:

1. Manually operated arrangement ("A"), adaptable for a transfer along a longitudinal extension of a rail (1), said arrangement having a cross-section formed by an upper rail head (1*a*), a rail web (1*b*) and a lower rail base (1*c*) and intended to be able to secure said rail against and to a subjacent crosstie (2) by a horizontal transfer of clips (3, 3*a*) included in fastening elements (4), and displaceably oriented along holders (5, 5*a*) included in the fastening elements (4), where the holders (5, 5*a*) co-operate firmly with said crosstie (2), and where the respective one of said clips (3, 3*a*) is adapted to, by a movement from a detached position, allow displacing the clips (3, 3*a*) horizontally for a co-operation with the rail base (1*c*) in relation to the holders (5, 5*a*), an opposed first pair of levers (6*a*, 6*b*) of a first lever-shaped means (6) being adaptable to, via lower end areas (6*aa*, 6*ab*) of said first lever-shaped means, cooperate with each of said clips (3, 3*a*) in order to activate counter-directed, horizontal movements, said first lever-shaped means (6) with said first pair of levers (6*a*, 6*b*) being turnably arranged around middle horizontal turning shafts (7, 8), and where said first lever-shaped means (6), via upper end areas (6*ac*, 6*ad*), co-operate with a first extensible device (9), such as a hydraulic piston-cylinder assembly (10), in order to bring said upper end areas (6*ac*, 6*ad*) from each other in a securing movement of the clips (3, 3*a*), said arrangement having a means (20) lifting the crosstie, with holders (5, 5*a*) and clips (3, 3*a*), up to the rail base (1*c*), wherein said lifting means provides an initial adjustment to a maximized height and said lifting means further comprises a second extensible device (21) having a variably adjustable end position, which at the maximized height is adapted to assume a fully brought together position.

2. Arrangement according to claim 1, characterized in that said second extensible device is a hydraulic piston-cylinder assembly.

3. Arrangement according to claim 2, characterized in that, in an initial position of said device, said second extensible device is adapted to assume an extended position (FIG. 9).

4. Arrangement according to claim 1, characterized in that said lifting means, including the second extensible device belonging thereto, is turnably fixed, via a turning shaft, to an upper part of said lifting means.

5. Arrangement according to claim 1, characterized in that said second extensible device is vertically adjustable via a manually actuatable handwheel co-operatable with a threaded rod.

6. Arrangement according to claim 1, characterized in that said second extensible device is adapted to assume an acute angle to a center line assigned to the rail.

7. Arrangement according to claim 1, characterized in that said second extensible device is adapted to, at a lower part of said second extensible device, co-operate with a roll, adapted for a cooperation with an upper surface portion or wear surface allocated to the rail head.

8. Arrangement according to claim 7, characterized in that said roll is allocated a centrally oriented rolling surface having a peripheral cylinder shape connecting to an upper support or wear surface assigned to the rail head.

9. Arrangement according to claim 8, characterized in that the rolling surface is adapted to extend between two end portions, having diameters that are related to the end portions and exceed a selected diameter of the rolling surface.

10. Arrangement according to claim 1, characterized in that the first pair of levers (6*a*, 6*b*) in the first lever-shaped means (6) is adapted for a lowering down to and a supporting co-operation with clips (3, 3*a*), laterally related to the rail base (1*c*), and the crosstie, and, via said means and said device, allow lifting the clips (3, 3*a*), and, in a thus raised position, allow creating a counter-directed movement of the clips across the upper surfaces of the rail base.

11. Arrangement according to claim 1, characterized in that the lower support surfaces of the first lever-shaped means are adapted for a parallel displacement in the horizontal direction toward each other, via a system of parallel levers, and an extension of the device.

12. Method for, in a manually operated arrangement ("A"), adaptable for a transfer along a longitudinal extension of a rail (1) and intended to be able to secure said rail against and to a subjacent crosstie (2) by a transfer of paired clips (3, 3*a*), included in fastening elements (4), and displaceably oriented along a holder (5) included in the fastening element (4), where the holder co-operates firmly with said crosstie (2), and where the respective one of said clips (3, 3*a*) is adapted to, by a movement, allow displacing the clips (3, 3*a*) for a clamping to said rail base (1*c*) along the respective holder (5), an opposed first pair of levers (6*a*, 6*b*) of a first lever-shaped means (6) being adapted to, via lower end areas (6*aa*, 6*ab*) of said first lever-shaped means, co-operate with each a clip (3, 3*a*) in order to activate counter-directed, horizontal movements, said first lever-shaped means (6), with said first pair of levers (6*a*, 6*b*), being turnably arranged around middle turning shafts (7, 8), and where said first lever-shaped means, via upper end areas (6*ac*, 6*ad*), are in a cooperation with an extensible device (9), such as a hydraulic piston-cylinder assembly (10), in order to bring said upper end areas (6*ac*, 6*ad*) from each other in a securing movement of the clips (3, 3*a*), and where said arrangement has a means (20) lifting the crosstie with the holders (5, 5*a*) and the clips (3, 3*a*) up to the rail base (1*c*), wherein said lifting means provides an initial adjustment to a maximized height and said lifting means further comprises a second extensible device (21) having a variably adjustable end position, which at the maximized height is adapted to assume a fully brought together position.

13. Method according to claim 12, characterized in that the first pair of levers of the first lever-shaped means are, at said lower end areas, provided with squeezing means co-ordinated to the clips, that the forces on said squeezing means are adapted to be less than an occurring static friction between the clips and the holders, that a shape corresponding to the shape of the free end of the clip is adapted to be able to lift the clips, the holder and the crosstie to the underside of the rail base as well as thereupon increase the forces in order to displace the clips toward each other for a securing movement.

14. Method according to claim 12, characterized in that said extensible device belonging to the lifting means should, in said initial adjustment position, assume an extended position.

15. Method according to claim 12, characterized in that said pair of levers in the first lever-shaped means (6) is adapted to initially assume a position registering with the clips, and, by forces less than counter-directed forces and requisite for an overcoming of an occurring static friction between said clips and said holders, next to allow lifting the crosstie with holders to the lower surface of the rail base, next to allow positioning the rail base against the crosstie and the holders, and finally to allow activating the horizontal displacement of the clips, for a securing co-operation with the upper surface portions of the rail base.

* * * * *